US011566329B2

(12) United States Patent
Hildebrand

(10) Patent No.: US 11,566,329 B2
(45) Date of Patent: Jan. 31, 2023

(54) DEVICE FOR ELECTROLESS METALLIZATION OF A TARGET SURFACE OF AT LEAST ONE WORKPIECE

(71) Applicant: AP & S INTERNATIONAL GMBH, Donaueschingen (DE)

(72) Inventor: Jörg Hildebrand, Donaueschingen (DE)

(73) Assignee: AP & S INTERNATIONAL GMBH, Donaueschingen (DE)

( * ) Notice: Subject to any disclaimer, the term of this patent is extended or adjusted under 35 U.S.C. 154(b) by 0 days.

(21) Appl. No.: 16/768,556

(22) PCT Filed: Nov. 30, 2018

(86) PCT No.: PCT/EP2018/083104

§ 371 (c)(1),
(2) Date: May 29, 2020

(87) PCT Pub. No.: WO2019/106137

PCT Pub. Date: Jun. 6, 2019

(65) Prior Publication Data

US 2020/0291526 A1 Sep. 17, 2020

(30) Foreign Application Priority Data

Nov. 30, 2017 (DE) ..... 10 2017 128 439.7

(51) Int. Cl.
*C23C 18/16* (2006.01)
*C23C 18/44* (2006.01)
(Continued)

(52) U.S. Cl.
CPC ..... *C23C 18/44* (2013.01); *C23C 18/163* (2013.01); *C23C 18/1669* (2013.01); *C23C 18/34* (2013.01); *C23C 18/40* (2013.01)

(58) Field of Classification Search
CPC ... C23C 18/163; C23C 18/1628; C23C 18/34; C23C 18/40; C23C 18/44; C23C 18/1669; C25D 17/002; C25D 17/02; B05C 11/11
See application file for complete search history.

(56) References Cited

U.S. PATENT DOCUMENTS 6,251,251 B1 * 6/2001 Uzoh ..... C25D 7/12 204/224 R
8,262,871 B1 * 9/2012 Mayer ..... C25D 17/008 204/263

(Continued)

FOREIGN PATENT DOCUMENTS

| | | | |
|---|---|---|---|
| JP | 06-081156 | A | 3/1994 |
| JP | 11-209877 | A | 8/1999 |
| KR | 20030056702 | A | 7/2003 |

*Primary Examiner* — Katherine A Bareford
(74) *Attorney, Agent, or Firm* — Nath, Goldberg & Meyer; Jerald L. Meyer; Morgan D. Rosenberg

(57) ABSTRACT

An assembly for electroless metallization of a target surface (11) of at least one workpiece (10), comprising—a container (13) for receiving an electrolyte solution—an inlet for the electrolyte solution, said inlet arranged in the base (15) of the container (13), wherein the inlet (20) is designed as an inlet port (21) with a diffuser plate (24) comprising inlet openings (25) arranged in concentric circles—an outlet (30) which is arranged on an upper side of the container (13)—a receiving area for holding the at least one workpiece (10), wherein the diffuser plate (24) is formed as a first assembly (31) and a second assembly (32), which is identical to the first assembly, of a respective plurality of inlet openings (25), wherein the assemblies at least partially but not completely overlap, and the inlet (20) has at least two inlet ports (21, 22).

14 Claims, 5 Drawing Sheets

(51) Int. Cl.
*C23C 18/34* (2006.01)
*C23C 18/40* (2006.01)

(56) References Cited

U.S. PATENT DOCUMENTS

2012/0000786 A1* 1/2012 Mayer ..... C25D 5/08
205/143
2013/0122704 A1* 5/2013 Kanda ..... H01L 24/742
438/678

* cited by examiner

Fig. 4A
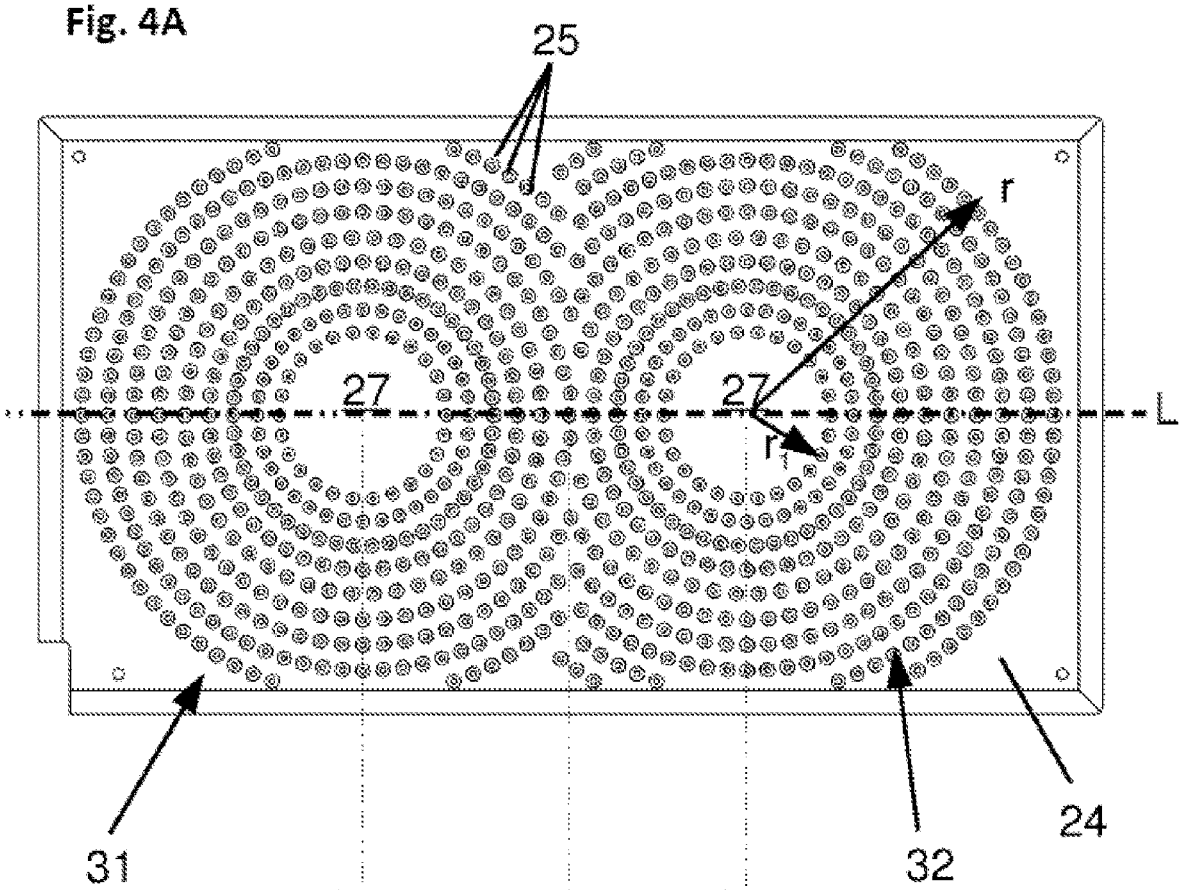
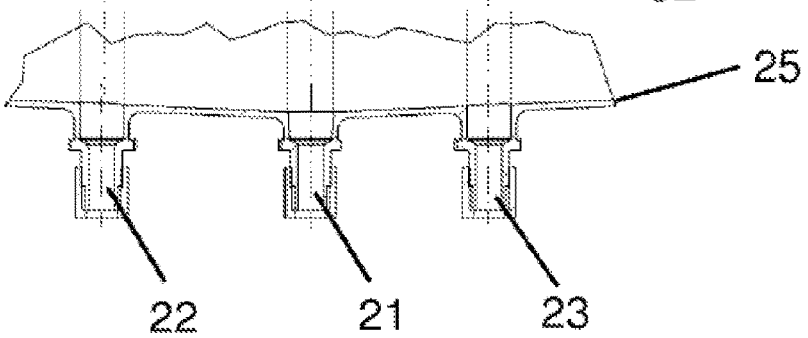
Fig. 4B

DEVICE FOR ELECTROLESS METALLIZATION OF A TARGET SURFACE OF AT LEAST ONE WORKPIECE

This is a National Phase Application filed under 35 U.S.C. 371 as a national stage of PCT/EP2018/083104, filed Nov. 30, 2018, an application claiming the benefit of German Application No. 10 2017 128 439.7 filed Nov. 30, 2017, the content of each of which is hereby incorporated by reference in its entirety.

BACKGROUND

1. Field

The present invention relates to a device for improving the homogeneity of a deposited metal layer during electroless metallization of a target surface of at least one workpiece, e.g., with copper, nickel, palladium, silver, or gold, as well as the alloys thereof.

2. Description of the Related Art

Electroless metal deposition from an electrolyte solution is basically known in the semi-conductor, solar, and nanotechnology sectors. Electroless metallization of objects, for example structured wafers, has significant advantages over galvanic metallization with respect to the resistance as well as the homogeneity and conformity of deposition technology and the properties of the achievable layers. It is advantageous that no devices are necessary for electrical contacting of the objects to be coated. In addition, the parallel processing of several objects by means of a batch process is a decisive advantage for increasing the production rate per unit of time. Due to the purely chemical deposition process, a seed layer on the objects is not absolutely necessary.

The process of electroless depositing of a metal layer requires a metal plating solution with a reducing agent, a metal source, and a chelating agent, wherein—in addition to control of the bath composition—parameters such as the pH value, the temperature, and the composition of the metal plating solution can also be adjusted with great accuracy, because initiation of a chemical reaction by means of a catalyst is extremely sensitive to the process temperature. The reaction can proceed autocatalytically or as an exchange or displacement reaction.

Typically, the operating temperature of the electroless electrolyte solution is in a range close to the autocatalysis temperature for spontaneous self-decomposition of the electroless electrolyte solution. The occurrence of self-decomposition of the electroless electrolyte solution leads to metal deposition not only onto desired regions, i.e. the substrate surface to be coated, but also onto surfaces of the metallization equipment such as the reactor cell, the electrolyte solution tank, the supply lines, and the like. In pronounced cases of self-initiated decomposition, essentially the entire metal content of the electrolytes is quickly reduced to a pure metal, which potentially causes clogging of all of the lines and tubes and of the processing basin. As a consequence of this, great effort is required in order to clean the metallization equipment in a wet-chemical manner with, for example, nitric acid and other chemicals, wherein all the expensive electrolyte components are lost at once. In addition, the resulting waste, which may be toxic in some cases, must be disposed of, which further significantly contributes to the operating expenses of the electroless metallization process.

The devices for electroless metallization known from the prior art are not designed as single-wafer systems but are for batch processes in order to increase the achievable production rate. In order to simultaneously process a plurality of wafers, they are placed in holders, or carriers, in a basin, which contains the electrolyte solution. Typically, the wafers are positioned vertically upright in the carriers, wherein the electrolyte solution is continuously circulated in the basins in order to ensure a uniform distribution of the reactants within the basin.

Typically, the electrolyte solution is placed in the basin from below via a central inlet and can be removed at the upper side and supplied for circulating and heating. The removal can be implemented, for example, via simple overflow into an overflow basin.

With the assemblies known from the prior art, the inlet for the electrolyte solution is arranged in the base of the container, wherein the inlet is designed as a single inlet port with additional diffuser plate. This diffuser plate has flow-optimized inlet openings in the form of concentric circles or differently arranged inlet openings.

With the devices known from the prior art, it is considered to be disadvantageous that the layer thickness of the deposited metal varies across a wafer and that there are also differences from wafer to wafer within a batch. The reasons for this are the variations in the surface potential of the circuits on the wafer and the hydrodynamics of the solution with respect to the surface, which leads to a reduction in the concentration of reactive electrolyte components over the surface of the objects to be metallized.

SUMMARY

Thus, the object of the present invention is to provide a device for the batch processing of wafers, which enables more uniform layer depositing within a wafer as well as from wafer to wafer, particularly for large wafers with diameters of up to 300 mm.

This object is achieved by the present assembly for electroless metallization of a target surface of at least one workpiece.

An assembly according to the invention for electroless metallization of a target surface of at least one workpiece comprising a container for receiving an electrolyte solution; an inlet for the electrolyte solution, said inlet arranged in the base of the container, wherein the inlet is designed as an inlet port with an additional diffuser plate; an outlet which is arranged on an upper side of the container; and a receiving area for holding the at least one workpiece is characterized in that the diffuser plate is formed as a first assembly and a second assembly, which is identical to the first assembly, of a respective plurality of circular inlet openings, wherein the assemblies at least partially but not completely overlap, and the inlet has at least two inlet ports.

Thus, the present invention is based on the knowledge that an improved supply of the electrolyte solution to the workpieces, particularly to wafers arranged in the assembly, can be achieved due to a supply of the electrolyte solution at several points, which are different from one another, with interconnected diffusers, and due to the use of several inlet ports, to the extent that a more homogenous distribution of the reactive electrolyte components (concentration distribution) can be achieved and thus a more homogenous layer deposition can be achieved as well over several wafers, which are arranged vertically, for example, in a wafer carrier in the container.

The first assembly and the second assembly can be arranged, for example, along a longitudinal axis of the container to the extent that an improved introduction is achieved over the longer sides of the wafer, along which the workpieces are typically arranged in rows. As a whole, it is advantageous when the diffuser plate is arranged centered in the base of the container such that a symmetrical construction is achieved. In this manner, the flow conditions toward the structured wafer surface can be optimized.

The inlet may further have at least three inlet ports for improving the aforementioned effects to the extent that further distribution optimization can be achieved when supplying the electrolyte solution.

In particular, a first inlet port may be aligned centered relative to the diffuser plate, and a second inlet port and a third inlet port advantageously may be aligned centered relative to the first assembly and to the second assembly, respectively.

The diffuser plate may have a baffle plate and/or a lower density of inlet openings in the area of the inlet ports to the extent that direct flow of the freshly supplied electrolyte solution and thus a local increase in concentration is avoided. In this manner, the homogeneity of the metal deposition can be improved over several workpieces.

Due to the use of individual pumps for each inlet, further optimization of the flow conditions can be achieved.

An especially simple design of the assembly can be achieved when all inlet openings have the same diameter. Alternatively, a concentration distribution can be achieved due to the different diameters of the inlet openings, for example with diameters increasing steadily as the distance away from the inlet ports increases.

In a preferred embodiment, a surface of the diffuser plate amounts to at least 95% of a base surface of the container and at least 3% open surface, due to the inlet openings, relative to the total surface of the diffuser plate.

The inlet ports may have respectively identical cross-sections, or the second inlet port and the third inlet port may have a cross-sectional surface of 45% of a cross-sectional surface of the first inlet port. Due to a change in the cross-sectional surface of the individual inlet ports, a concentration distribution within the container can likewise be influenced.

The inlet openings may be arranged, for example, in concentric circles or in a spiraling line.

The inlet openings in this case are equipped with chamfers at the drilled holes on both sides in order to further optimize the media distribution and in order to prevent interfering edges. The inlet openings are aligned vertically.

The diameters of the inlet openings in this case are executed so as to increase and be in the shape of a circle relative to the center and/or the baffle plate of the diffuser plate.

The present invention is extensively explained in the following by means of an exemplary embodiment with reference to the enclosed figures. The following is shown:

BRIEF DESCRIPTION OF THE DRAWINGS

FIG. 4A illustrates an exemplary embodiment of a diffuser plate from FIG. 3, in a view from below;

FIG. 4B illustrates an arrangement of three inlet ports relative to the diffuser plate from FIG. 4*a;*

DETAILED DESCRIPTION OF THE PREFERRED EMBODIMENTS

Figure 1:
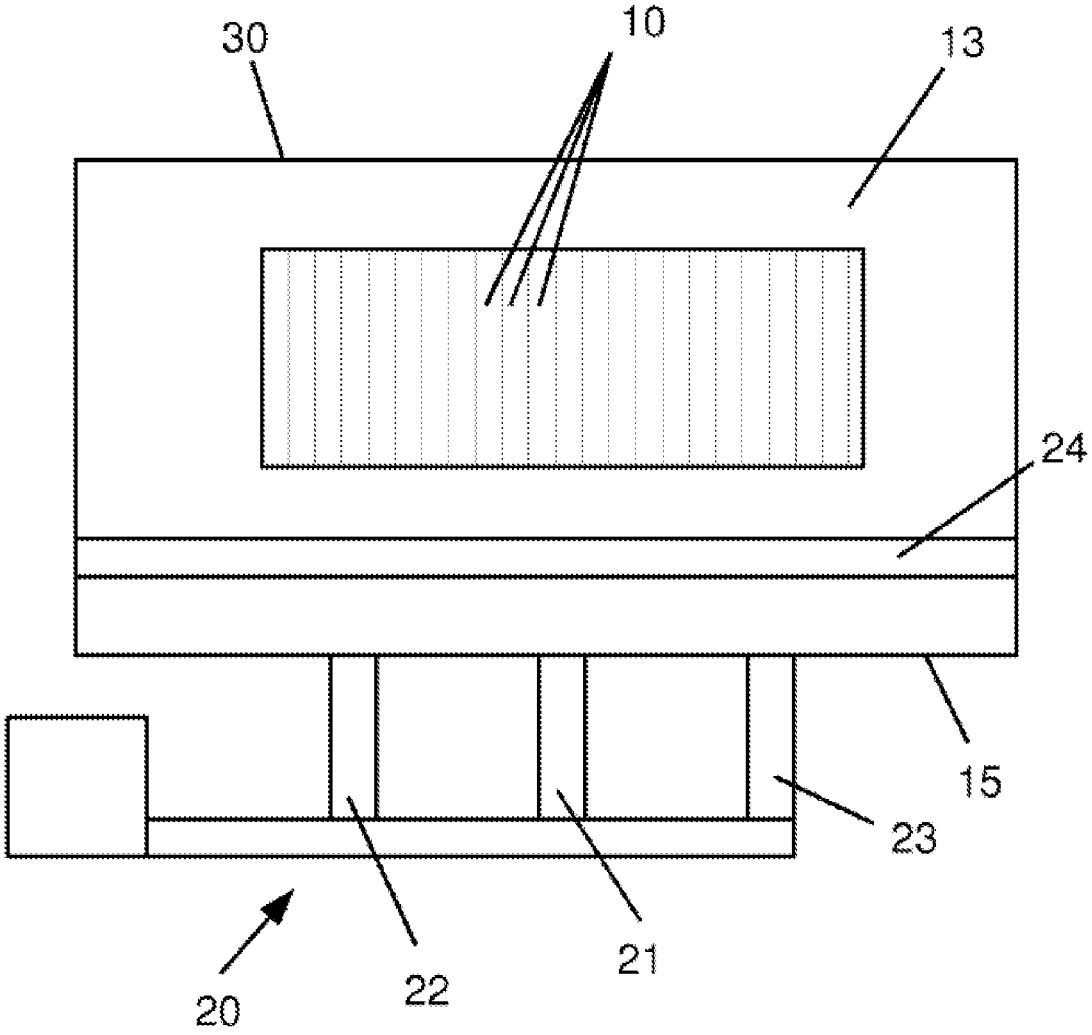
FIG. 1 is a schematic sectional view of an assembly for electro-less metallization according to the present invention.

FIG. 1 shows a schematic sectional view of an assembly for electroless metallization according to the present invention.

FIG. 1 shows a longitudinal section of a container 13, in which a plurality of workpieces 10 to be coated, for example semiconductor wafers, are arranged vertically upright in a so-called wafer carrier. In the present exemplary embodiment, a first inlet port 21, a second inlet port 22, as well as a third inlet port 23 are arranged in a base 15 of the container 13 along the longitudinal axis and centrally in the transverse direction. An electrolyte solution for electroless metallization of the workpieces 10 arranged in the container 13 can be supplied to the container 13 via the inlet ports 21, 22, 23. In order to achieve sufficient homogeneity when coating the workpieces 10, a diffuser 24, which is designed as a diffuser plate in this case, is arranged between the inlet ports 21, 22, 23 and the section of the container 13 in which the workpieces 10 are arranged.

To this end, the diffuser plate 24 is arranged in a lower fourth of the container 13 such that the diffuser plate is arranged between the workpieces 10 and an inlet 20, which is formed by the inlet ports 21, 22, 23, and thus a distribution of the medium supplied via the inlet 20 is ensured. Because the electrolyte solution, which is used for the metallization of the workpieces 10 in this case, is continuously recirculated during implementation of the metallization process, i.e. the electrolyte solution, which flows out of the container 13 via an upper edge of the container 13, which forms an outlet 30 in this case, is captured and then is supplied back to the container 13 via the inlet 20 arranged on the base, the diffuser plate 24 ensures a distribution of concentration that is as homogenous as possible of the reactants contained in the electrolyte solution to the extent that homogenous metal deposition takes place.

Figure 2:
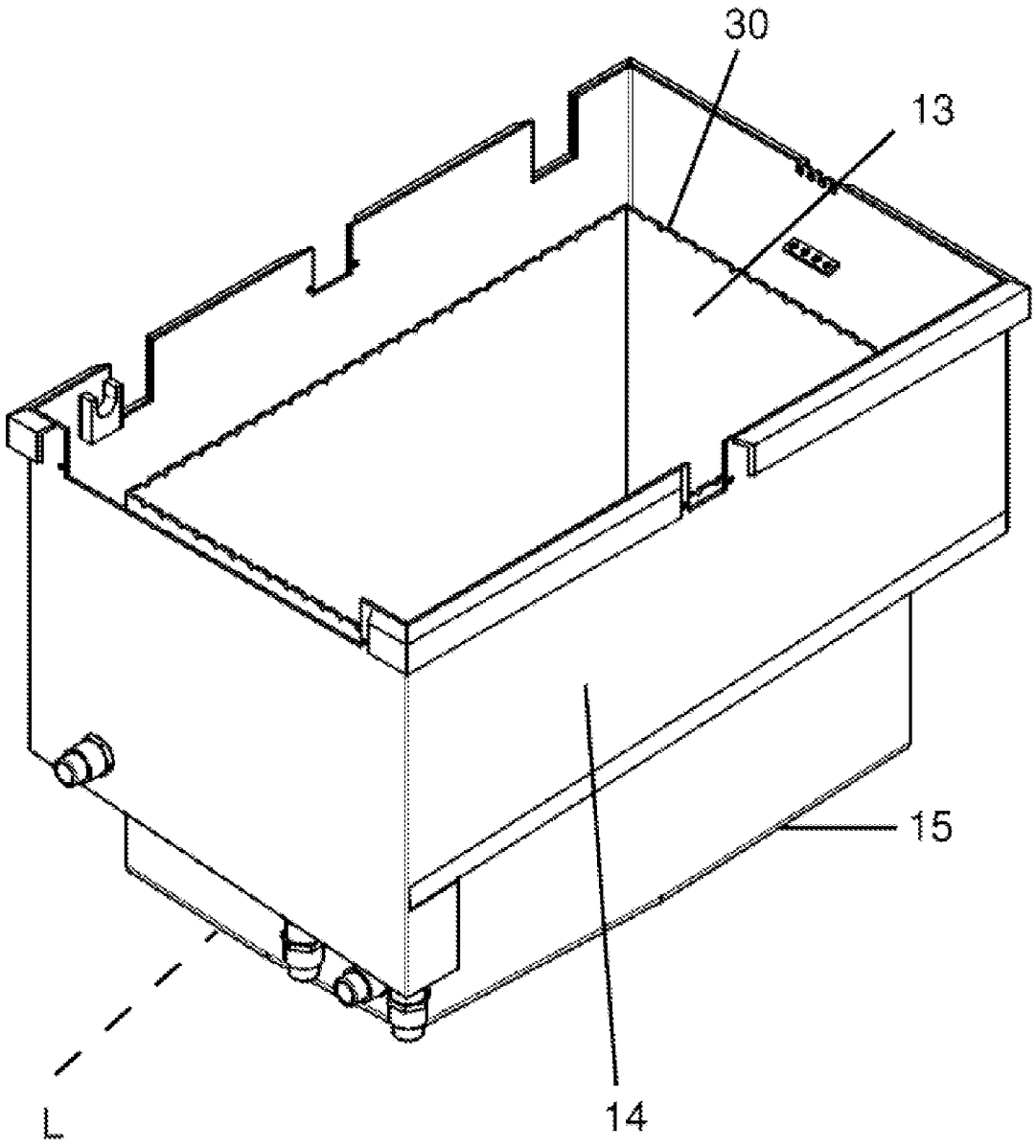
FIG. 2 is a perspective view of the assembly from FIG. 1.

FIG. 2 shows the assembly, which is only shown schematically in FIG. 1, in a more detailed perspective view.

It can be seen that the container 13, which is designed as a quartz glass container in this exemplary embodiment, is substantially in the shape of a cube and is surrounded by an overflow container 14 for capturing the medium flowing over the upper edge, which is formed as an outlet 30. The overflow container 14 has different connection ports, which are formed for guiding the electrolyte solution or as connections for cleaning the assembly. Furthermore, various attachment parts can be seen on the overflow container 14, which are designed, for example, for holding or implementing various retainers for the workpieces 10.

Figure 3:
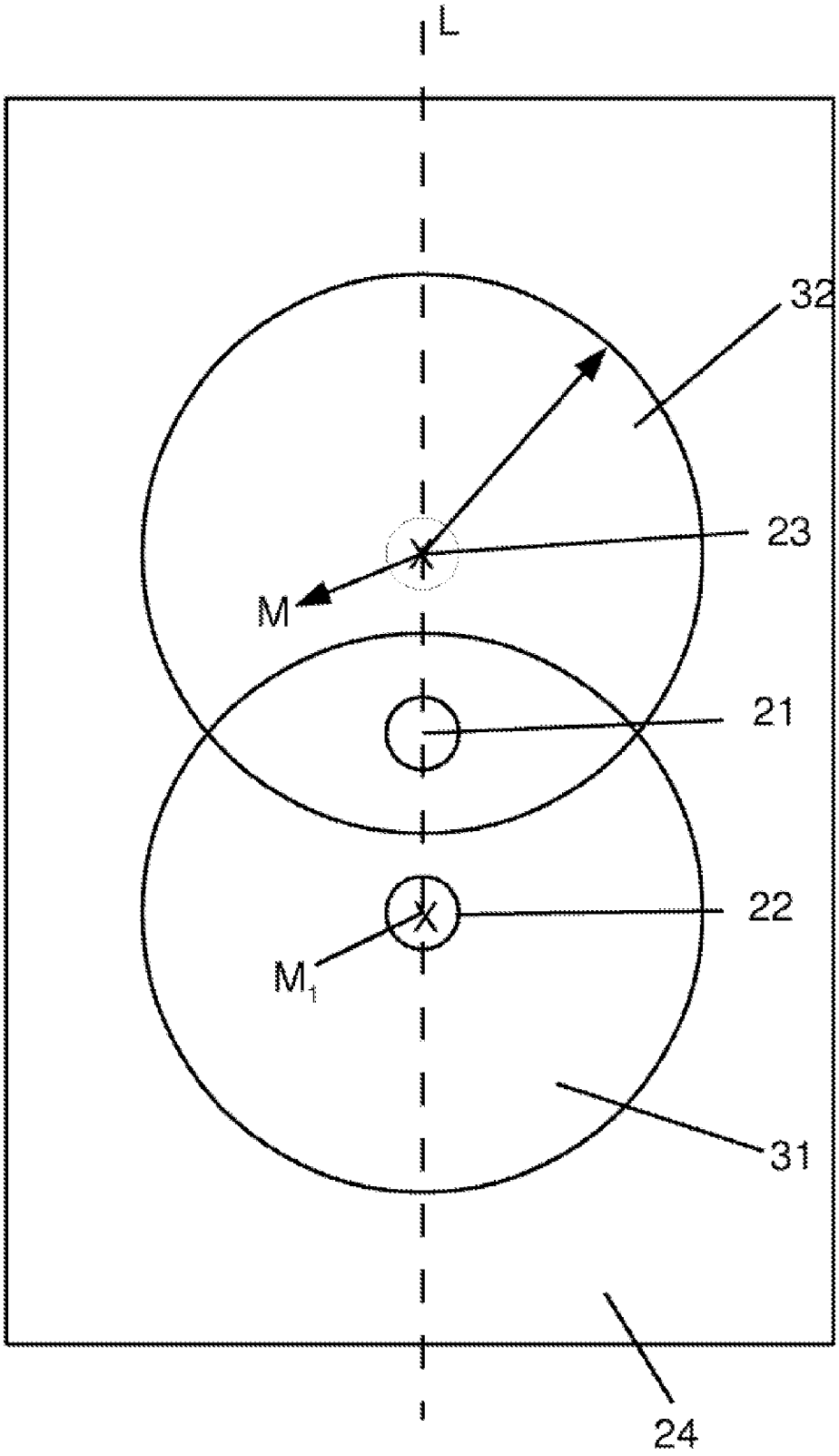
FIG. 3 is a schematic top view of a diffuser plate as it is used in an assembly according to FIGS. 1 and 2.

Finally, FIG. 3 shows a schematic top view of a diffuser plate 24 as it can be used in an assembly according to FIGS. 1 and 2.

In the present exemplary embodiment, the diffuser plate 24 is substantially shaped as a rectangle, wherein, in the view shown in FIG. 3, a first assembly 31 and a second assembly 32 are obvious, which are designed as overlapping circles in sections. The circles in the middle points $M_1$, $M_2$ of the two assemblies 31, 32 are arranged on the longitudinal axis L, which corresponds to an axis of symmetry, of the diffuser plate 24, extending in the longitudinal direction, to the extent that the two assemblies 31, 32 overlap in sections, wherein a totality of the assemblies 31, 32 is arranged centrally on the diffuser plate 24 in the longitudinal direction.

In addition, FIG. 3 shows the arrangement of the inlet ports 21, 22, 23 relative to the assemblies 31, 32. In the exemplary embodiment shown, the second inlet port 22 is aligned concentric to the first assembly 31 and the third inlet port 23 is aligned concentric to the second assembly 32. The first inlet port 21, just as the two other inlet ports 22, 23, is arranged along the longitudinal axis L in this case, precisely between the second inlet port 22 and the third inlet port 23. Thus, the first inlet port 21 is arranged equidistant to the two other respective inlet ports.

FIG. 4A shows a potential embodiment of a diffuser plate 24, as is only shown schematically in FIG. 3, In this exemplary embodiment, the diffuser plate 24 has a plurality of inlet openings 25, which are arranged in concentric circles. In order to achieve an optimum distribution of the medium supplied via the inlet ports 21, 22, 23, the first assembly 31 and the second assembly 32 have centrally arranged baffle plates 27 in the exemplary embodiment shown in FIG. 4A, in which no inlet openings 25 are arranged in the area of the baffle plates. The baffle plates are thus formed by an area implemented free of openings, starting from the respective middle point of the assembly 31, 32 and proceeding to a first radius $r_1$. The baffle plates 27 provide an improved distribution of the medium supplied via the second inlet port 22 and the third inlet port 23.

The view of the diffuser plate 24 shown in FIG. 4A further shows that the diffuser plate 24 is chamfered about the circumference. This means that, upon the placement of the diffuser plate 24 in the container 13, a self-centering of the diffuser plate relative to the container 13 is achieved on correspondingly formed overlays through the circulating phase. FIG. 4A further shows that the inlet openings 25 can have different diameters. In the exemplary embodiment shown, the inlet openings 25 of the two innermost circles of inlet openings 25 are formed with a smaller diameter and thus with less flow cross-section in the assemblies 31, 32. This can also be used to adjust the concentration distribution within the container 13.

FIG. 4B, when viewed together with FIG. 4A, shows the inlet ports 21, 22, 23 as well as the alignment thereof relative to the diffuser plate 24.

Figure 5:
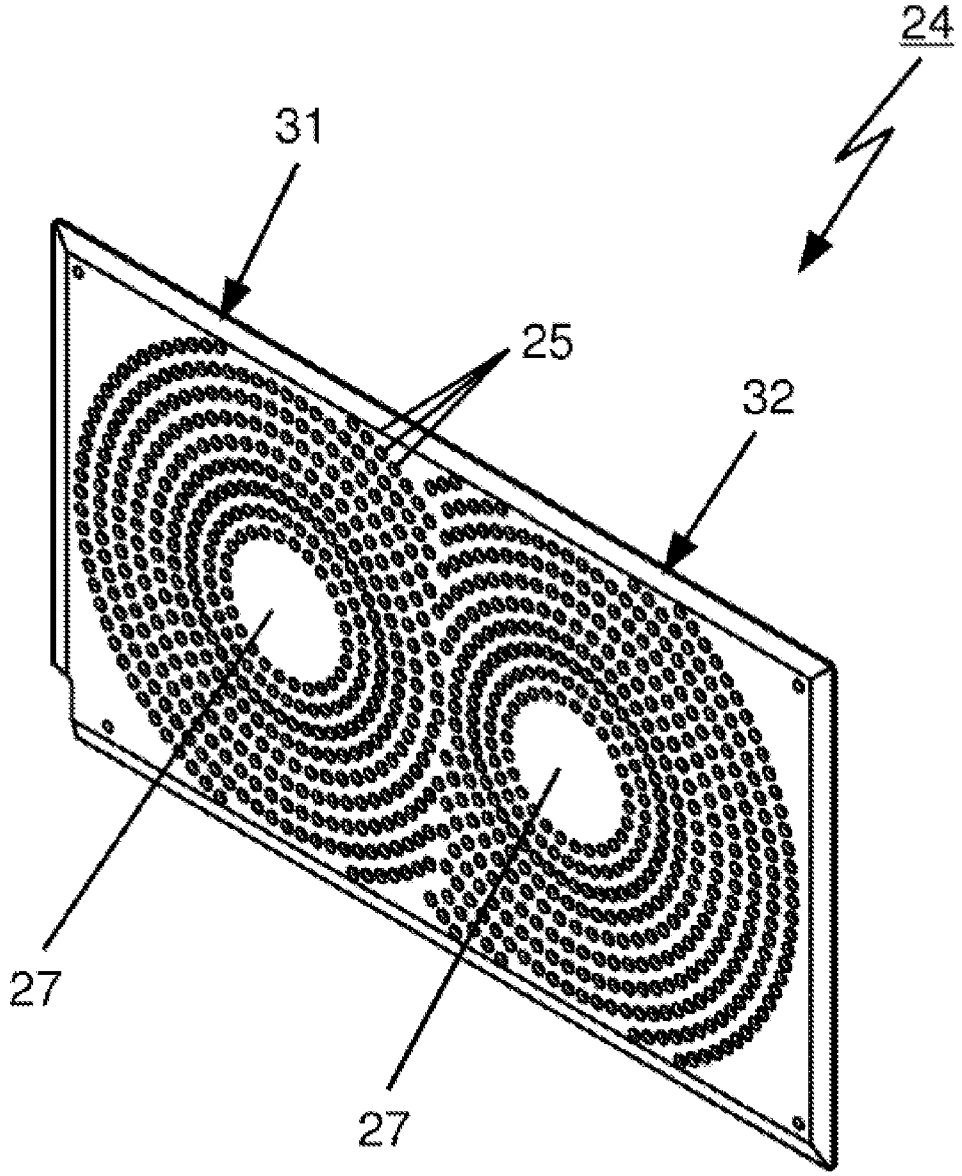
FIG. 5 illustrates the diffuser plate from FIG. 4A in a perspective view.

FIG. 5 shows the diffuser plate 24 from FIG. 4A in a perspective view. FIG. 5 shows a perspective view from below, in which the circulating phase of the diffuser plate 24 can be easily seen. Furthermore, FIGS. 4A and 5 show that the first assembly 31 and the second assembly 32 are guided up to the edge of the diffuser plate 24 in the direction of the longitudinal axis L. In the transverse direction, i.e. in a direction at a right angle to the longitudinal axis L, the assemblies 31, 32 likewise reach the edge of the diffuser plate—the chamfered area has been removed—wherein the underlying circular shape of the assemblies 31, 32 would actually reach beyond the edge of the diffuser plate 24. As previously shown, the inlet openings 25 are arranged in concentric circles.

LIST OF REFERENCE NUMERALS

10 Workpiece/wafer
11 Target surfaces
13 Container
14 Overflow container
15 Base
20 Inlet
21 First inlet port
22 Second inlet port
23 Third inlet port
24 Diffuser
25 Inlet openings
27 Baffle plates
30 Outlet
31 First assembly
32 Second assembly
90 Inlet
91 Inlet port
L Longitudinal axis
d Diameter
$A_D$ Surface
$A_B$ Base surface
$A_Z$ Cross-sectional surface

The invention claimed is:

1. An assembly for electroless metallization of a target surface (11) of at least one workpiece (10), comprising:

a container (13) for receiving an electrolyte solution;

an inlet for the electrolyte solution, said inlet arranged in a base (15) of the container (13), wherein a diffuser plate (24) with a plurality of inlet openings (25) is arranged on an inside of the container above the inlet (20);

an outlet (30) arranged on an upper side of the container (13); and a receiving area for holding the at least one workpiece (10), wherein the at least one workpiece (10) is arranged vertically upright in the receiving area, wherein the plurality of inlet openings (25) formed through the diffuser plate (24) are evenly divided into a first assembly (31) and a second assembly (32), which is identical to the first assembly, wherein the first assembly (31) and the second assembly (32) partially overlap, wherein each of the first assembly (31) and the second assembly (32) has a circular configuration, with the plurality of inlet openings (25) of each of the first assembly (31) and the second assembly (32) being arranged in a pattern of concentric circles, and wherein the inlet (20) comprises at least a first inlet port (22) and a second inlet port (23), wherein the first inlet port (22) and the second inlet port (23) are coaxially aligned with respective centers of the first assembly (31) and the second assembly (32), and wherein the diffuser plate (24) comprises a first baffle region located centrally within the first assembly (31) and a second baffle region located centrally within the second assembly (32), the first and second baffle regions being solid and free of the inlet openings (25), such that the first inlet port (22) and the second inlet port (23) are not positioned directly beneath the plurality of openings (25).

2. The assembly according to claim 1, wherein the first assembly (31) and the second assembly (32) are arranged along a longitudinal axis (L) of the container (13).

3. The assembly according to claim 2, wherein the diffuser plate (24) is arranged centered on the base of the container (13).

4. The assembly according to claim 3, wherein the inlet (20) comprises at least the first inlet port (22), the second inlet port (23) and a third inlet port (21).

5. The assembly according to claim 4, wherein the third inlet port (21) is aligned centered relative to the diffuser plate (24), and the first inlet port (22) and the second inlet port (23) are aligned with the third inlet port (21).

6. The assembly according to claim 5, wherein the first inlet port (22) and the second inlet port (23) have a cross-sectional surface ($A_Z$) of 45% of a cross-section of the third inlet port (21).

7. The assembly according to claim 1, wherein all of the inlet openings (25) have an identical diameter (d).

8. The assembly according to claim 1, wherein a surface of the diffuser plate (24) covers at least 95% of a base surface ($A_B$) of the base of the container (13).

9. The assembly according to claim 1, wherein the first, second and third inlet ports (22, 23, 21) have an identical cross-sectional surface ($A_Z$).

10. The assembly according to claim 1, wherein at least one pump is provided for the inlet.

11. The assembly according to claim 1, wherein a diameter of each of the inlet openings of each of the first assembly (31) and the second assembly (32) increases as a radius r measured from a center of a corresponding one of the first and second assemblies increases.

12. The assembly according to claim 11, wherein the diameter of each of the inlet openings is at least 0.15 cm.

13. The assembly according to claim 1, wherein the diffuser plate (24) has at least 248 inlet openings (25).

14. The assembly according to claim 13, wherein the plurality of inlet openings (25) span 3% of a total surface area of the diffuser plate (24).

* * * * *